US011148921B2

(12) United States Patent
Erickson et al.

(10) Patent No.: US 11,148,921 B2
(45) Date of Patent: Oct. 19, 2021

(54) POTHOLE PROTECTION MECHANISM FOR A LIFT MACHINE

(71) Applicant: JLG Industries, Inc., McConnellsburg, PA (US)

(72) Inventors: Matthew S. Erickson, Winneconne, WI (US); Jeremy L. Kiekhaefer, Omro, WI (US)

(73) Assignee: JLG Industries, Inc., McConnellsburg, PA (US)

( * ) Notice: Subject to any disclaimer, the term of this patent is extended or adjusted under 35 U.S.C. 154(b) by 176 days.

(21) Appl. No.: 16/480,359

(22) PCT Filed: Jan. 25, 2018

(86) PCT No.: PCT/US2018/015209
§ 371 (c)(1),
(2) Date: Jul. 24, 2019

(87) PCT Pub. No.: WO2018/144311
PCT Pub. Date: Aug. 9, 2018

(65) Prior Publication Data

US 2019/0389706 A1 Dec. 26, 2019

Related U.S. Application Data

(60) Provisional application No. 62/452,638, filed on Jan. 31, 2017.

(51) Int. Cl.
*B66F 17/00* (2006.01)
*B66F 9/075* (2006.01)

(52) U.S. Cl.
CPC ..... *B66F 17/006* (2013.01); *B66F 9/07559* (2013.01); *B66F 17/00* (2013.01)

(58) Field of Classification Search
CPC .... B66F 17/006; B66F 9/07559; B66F 17/00; B66F 9/075; B66F 9/24; B66F 11/04
See application file for complete search history.

(56) References Cited

U.S. PATENT DOCUMENTS

| | | | |
|---|---|---|---|
| 5,388,857 | A | 2/1995 | Wernimont et al. |
| 5,890,737 | A | 4/1999 | Hutka |
| 6,425,459 | B1 | 7/2002 | Keefer |

(Continued)

FOREIGN PATENT DOCUMENTS

| | | |
|---|---|---|
| CN | 100506680 | 2/2008 |
| CN | 102815649 | 12/2012 |
| JP | 5248047 | 4/2013 |

OTHER PUBLICATIONS

International Search Report dated Apr. 12, 2018 issued in PCT International Patent Application No. PCT/US2018/01529, 1 page.

*Primary Examiner* — Drew J Brown
(74) *Attorney, Agent, or Firm* — Nixon & Vanderhye P.C.

(57) ABSTRACT

A pothole protection mechanism provides additional support for a lift vehicle in the event a wheel is driven into a hole while the platform is elevated. The mechanism includes a pair of extendible and retractable pothole protection bars. A mechanism serves to actuate the pothole protection mechanism based on a position of the vehicle lifting section. Components are included to provide support when deployed, to assist in deploying, and to enable platform lift down in the event that the pothole protection bars are stuck in the deployed position.

10 Claims, 5 Drawing Sheets

(56) References Cited

U.S. PATENT DOCUMENTS

| | | | | |
|---|---|---|---|---|
| 6,561,546 | B2 | 5/2003 | Puszkiewicz et al. | |
| 7,281,736 | B2 | 10/2007 | Sannah et al. | |
| 7,950,695 | B2 | 5/2011 | Cui | |
| 8,267,222 | B2 | 9/2012 | Cui | |
| 9,914,626 | B2 * | 3/2018 | Shugen | B66F 9/205 |
| 9,914,627 | B2 * | 3/2018 | Shugen | B65G 1/04 |
| 10,676,334 | B2 * | 6/2020 | Pithoud | B66F 17/006 |
| 2005/0224290 | A1 | 10/2005 | Sannah et al. | |
| 2017/0291802 | A1 * | 10/2017 | Hao | E01B 27/17 |
| 2019/0309901 | A1 * | 10/2019 | Crook | B62D 5/062 |

* cited by examiner

POTHOLE PROTECTION MECHANISM FOR A LIFT MACHINE

CROSS-REFERENCES TO RELATED APPLICATIONS

This application is the U.S. national phase of International Application No. PCT/US2018/015209 filed Jan. 25, 2018 which designated the U.S. and claims priority to U.S. Provisional Patent Application No. 62/452,638 filed Jan. 31, 2017, the entire contents of each of which are hereby incorporated by reference.

STATEMENT REGARDING FEDERALLY SPONSORED RESEARCH OR DEVELOPMENT (Not Applicable)

BACKGROUND

The present invention relates to a pothole protection mechanism for a vehicle including an aerial work platform (AWP).

Self-propelled AWPs such as scissor lifts are typically equipped with an apparatus that provides additional support for the lift in the event that a wheel is driven into a hole or off a curb or the like. Such an apparatus works normally by reducing the ground clearance to less than one inch when the platform of the AWP is elevated beyond a certain height.

One way of achieving this is by means of a bar or a plate that is attached to the chassis of the AWP that can be lowered down and locked in position when the platform is elevated. Subsequently, the bar or plate can be raised up when the platform is lowered.

The bars along with the mechanism that performs the lowering, locking and raising tasks are referred to as a pothole protection mechanism. When a lift machine to which the pothole protection mechanism is attached falls into a pothole or off a curb, the mechanism will limit the amount distance the machine can drop while the platform is elevated. Typical pothole protection mechanisms contain horizontal bars or the like installed on sides of a vertical lift platform vehicle. The bars are deployed or extended when the platform is raised, and the bars are lifted or retracted when the platform is lowered to allow the machine to drive over ramps, obstacles and the like.

BRIEF SUMMARY

According to the described embodiments, as the lift machine platform is raised, pressure will be released from a spring loaded actuator, which allows the pothole protection bars to drop down, thereby limiting the amount of clearance the lift machine has to the around. Many design features have been implemented to decrease cost and maintain functionality. The pothole protection bars are mechanically linked by, for example, a rack and pinion design, which is an effective mechanism for converting a downward arm stack movement into vertical movement to raise the pothole protection bars. Since the pothole protection bars are mechanically linked, it also allows the device to use one sensor instead of two.

In use, in the extended or deployed position, the linkage pivot joints are pivoted to an over-center position and are abutted against a frame-mounted stop. As such, when a vehicle to which the pothole protection mechanism is attached falls into a pothole or off a curb or the like, the weight of the machine is supported by the pothole protection bar and support linkage and not by the actuator.

In an exemplary embodiment, a pothole protection mechanism for a lift vehicle including a lifting section supported on a vehicle frame includes a plunger bar displaceable with the lifting section and a pair of arm assemblies displaceable by the plunger bar between a retracted position and a deployed position. Each of the arm assemblies includes an extension arm engaged with the plunger bar and pivotable on a first pivot pin and a bar arras pivotably coupled at a proximal end to the extension arm on a second pivot pin. A pair of pothole protection bars are one each pivotably coupled on a third pivot pin to respective distal ends of the bar arms via respective bar mounting tabs. Each of the bar mounting tabs is pivotably connectable to the vehicle frame. The arm assemblies are configured such that the bar arms are pivoted over center on the second pivot pin when the arm assemblies are displaced front the retracted position to the deployed position.

The vehicle frame may include stop members disposed in a deploy path of the arm assemblies, where in the deployed position, either the bar arms or the extension arms are engaged with the stop members. Each of the bar mounting tabs may include a slot in which the pothole protection bar is positioned. A deploy spring cooperable with the plunger bar may be configured to bias the plunger bar toward displacing the arm assemblies to the deployed position.

The plunger bar may be linked to the pair of arm assemblies. For example, the plunger bar may include a two-sided rack, where each of the extension arms may include a pinion at proximal ends thereof engaging respective sides of the two-sided rack. The pothole protection mechanism may also include an actuator spring cooperable with the plunger bar that is configured to permit lift down of the lifting section when the arm assemblies are stuck in the deployed position. A single sensor may be configured to determine when the mechanism is deployed.

In another exemplary embodiment, a pothole protection mechanism includes a plunger bar displaceable with the lifting section, a pair of arm assemblies mechanically linked to each other through the plunger bar and displaceable by the plunger bar between a retracted position and a deployed position, and a pair of pothole protection bars, one each pivotably coupled to the arm assemblies via respective bar mounting tabs. Each of the bar mounting tabs are pivotably connectable to the vehicle frame. A deploy spring cooperable with the plunger bar is configured to bias the plunger bar toward displacing the arm assemblies to the deployed position.

In yet another exemplary embodiment, a lift vehicle incorporates the pothole protection mechanism of the described embodiments.

BRIEF DESCRIPTION OF THE DRAWINGS

These and other aspects and advantages will be described in detail with reference to the accompanying drawings, in which.

DETAILED DESCRIPTION

Figure 1:
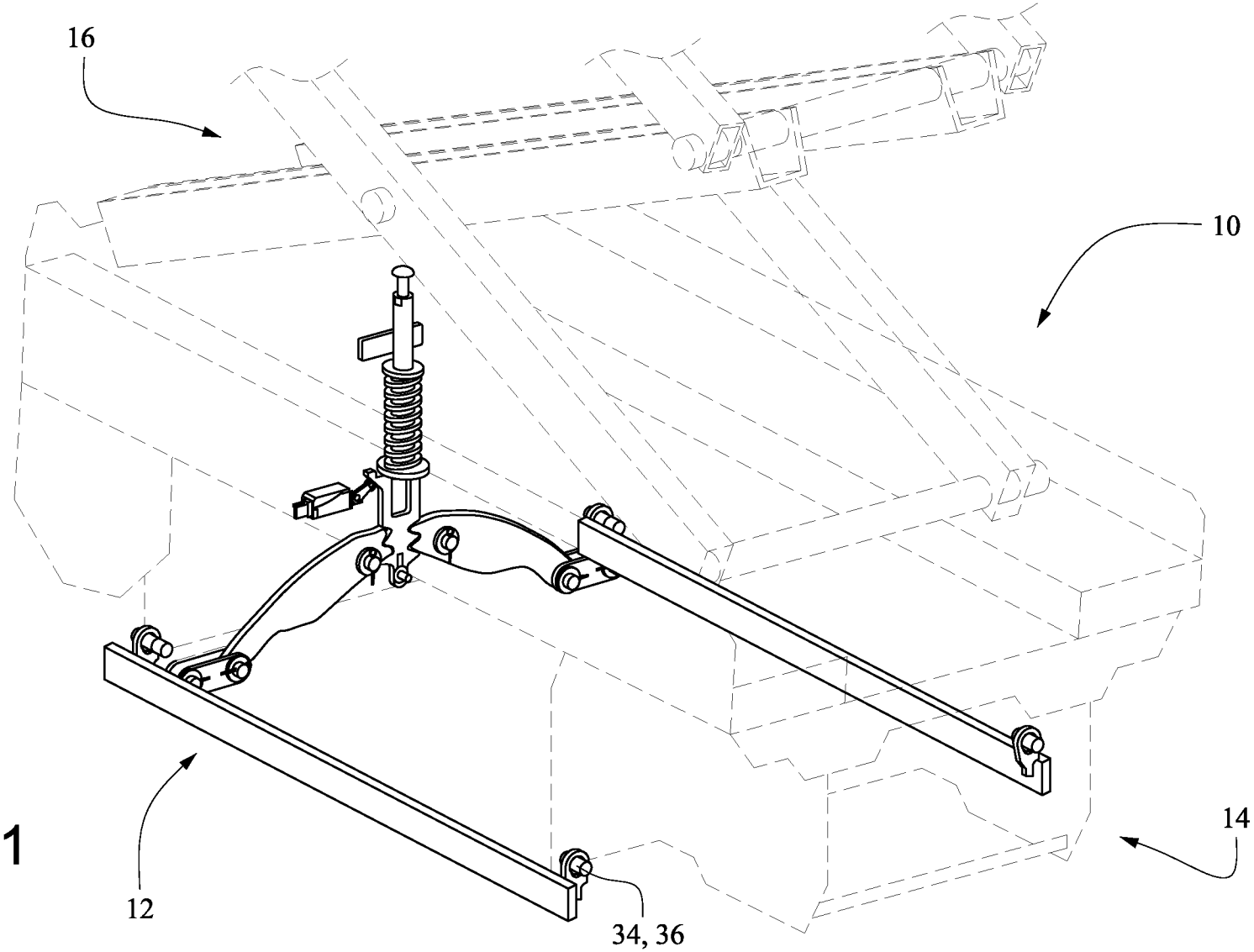
FIG. 1 is a perspective view showing the pothole protection mechanism of the described embodiments on a lift vehicle.

FIG. 1 shows an exemplary lift vehicle 10 including a pothole protection mechanism 12 according: to the described embodiments. The lift vehicle 10 in FIG. 1 is a scissor lift to which the use of the pothole protection mechanism 12 of the described embodiments is particularly applicable. The scissor lift, however, is exemplary, and the invention is not necessarily meant to be limited to a scissor lift vehicle.

The vehicle 10 includes a vehicle frame 14 and a lifting section 16, such as a scissor arm stack in the exemplary scissor lift shown, supported on the vehicle frame. The pothole protection mechanism 12 is connected between the vehicle frame 14 and the lifting section 16.

Figure 2:
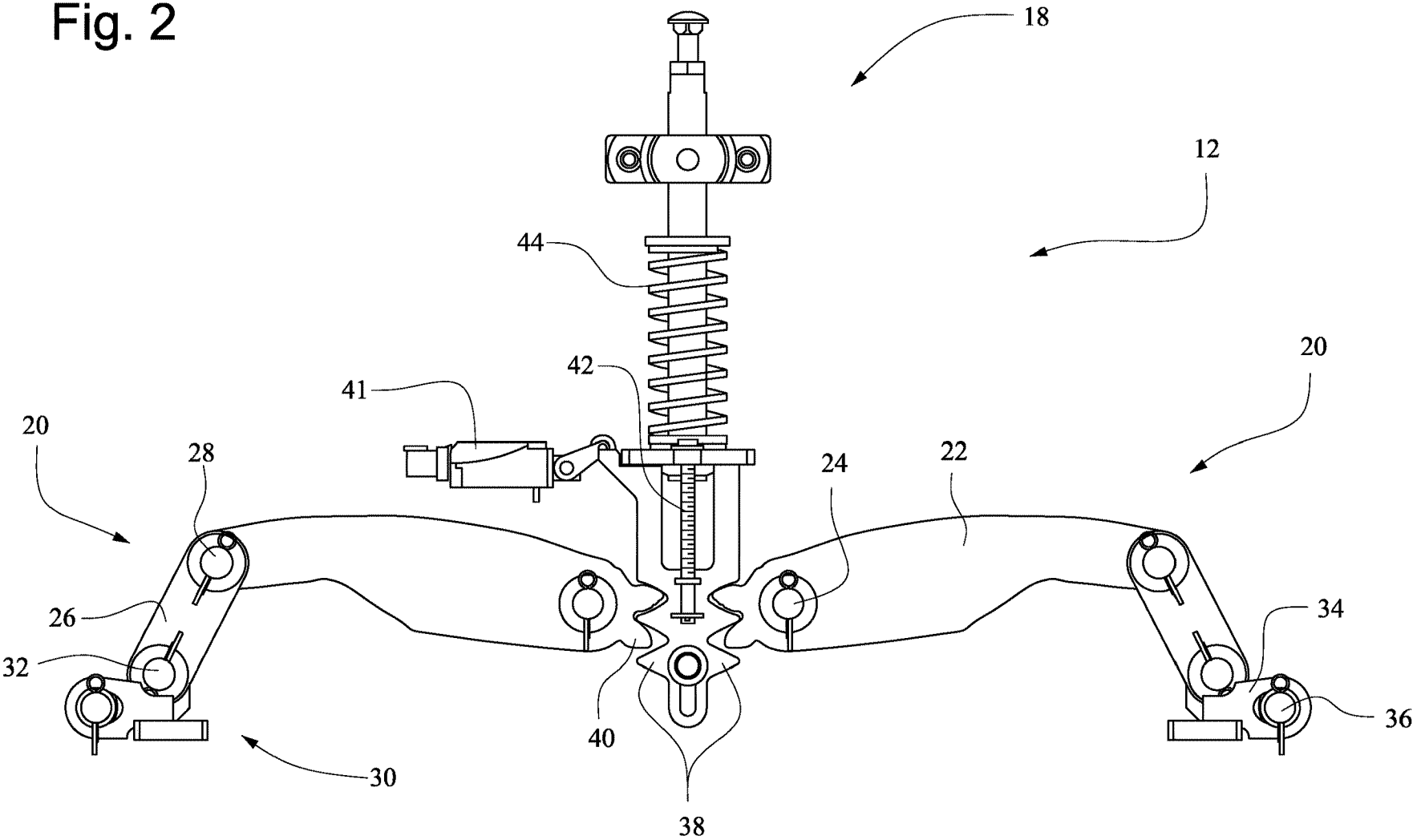
FIG. 2 shows the pothole protection mechanism in a retracted configuration.
Figure 3:
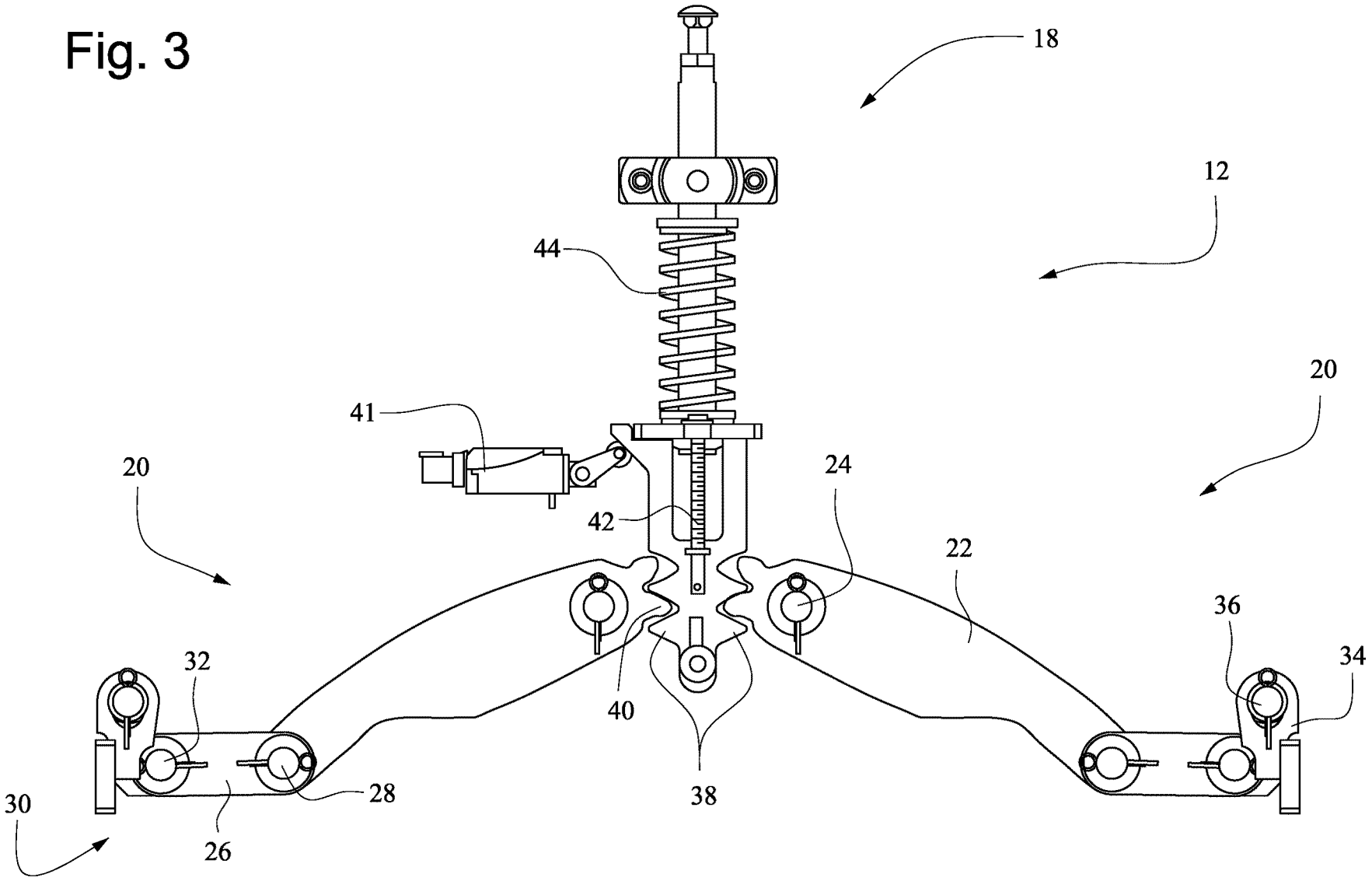
FIG. 3 shows the pothole protection mechanism in a deployed configuration.

FIGS. 2 and 3 show the pothole protection mechanism in a retracted configuration and a deployed configuration, respectively. The pothole protection mechanism 12 includes a plunger bar 18 connected to and displaceable with the lifting section 16. A pair of arm assemblies 20 are displaceable by the plunger bar 18 between a retracted position (FIG. 2) and a deployed position (FIG. 3). Each of the arm assemblies 20 includes an extension arm 22 engaged with the plunger bar 18 and pivotable on a first pivot pin 24. The arm assemblies 20 also include a bar arm 26 pivotably coupled at a proximal end to the extension arm 22 on a second pivot pin 28.

Figure 4:
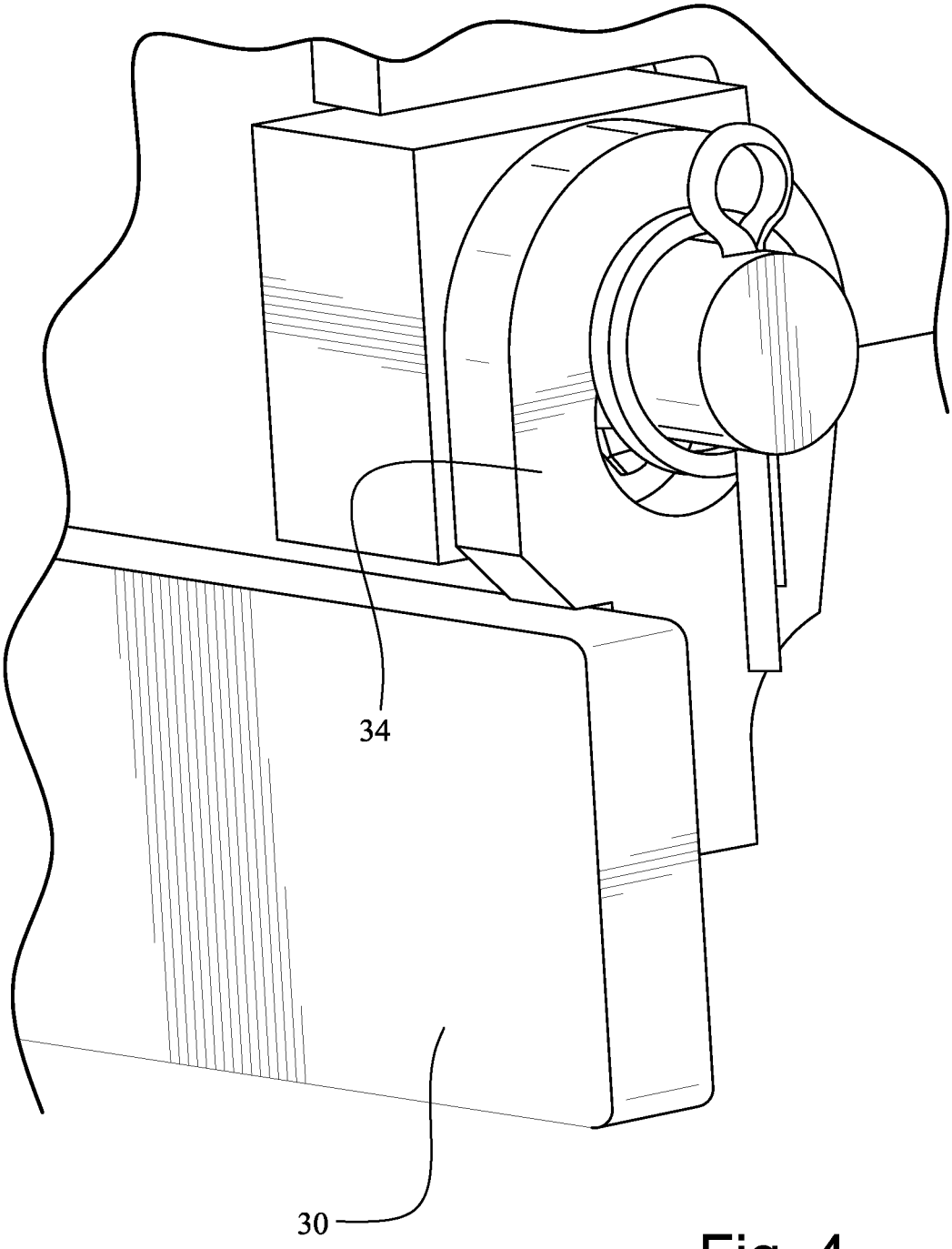
FIG. 4 is a close-up view of the pothole protection bar and slotted bar mounting tab.

A pair of pothole protection bars 30 are each pivotably coupled on a third pivot pin 32 to respective distal ends of the bar arms 26 via respective bar mounting tabs 34. The bar mounting tabs 34 are pivotably connected to the vehicle frame 14 via a fourth pivot pin 36 (see also FIG. 1). As shown in FIG. 4, each of the bar mounting labs 34 may be slotted to allow the bar 30 to rest against the vehicle frame 14 when deployed. In this manner, impact forces upon falling into a pothole or the like may be transferred to the vehicle frame 14 rather than the pothole protection mechanism 12. That is, the slotted bar mounting tabs 34 allow the pothole protection bars 30 to directly contact the frame 14 during a pothole impact and not pass the load through pins and bearings of the mechanism.

The plunger bar 18 is linked to the pair of arm assemblies 20 by a suitable linking configuration. In the exemplary embodiment shown in FIGS. 2 and 3, the plunger bar 18 includes a two-sided rack 38, and each of the extension arms 22 includes a pinion 40 at proximal ends thereof engaging respective sides of the two-sided rack 38. In this configuration, as the plunger bar 18 is raised by virtue of raising the lifting, section 16 of the lift vehicle 10, the two-sided rack 38 is raised with the plunger bar 18, and the extension arms 22 are pivoted downward on pivot pin 24 by the pinion 40 engaging the two-sided rack 38 of the plunger bar 18. The pothole protection bars 30 are thus mechanically linked to each other through the mutual connections between the rack and pinion assembly 38, 40. The rack and pinion assembly is an effective mechanism for converting arm stack movement of the lift vehicle into vertical movement to raise and lower the pothole protection bars 30. Since the pothole protection bars 30 are mechanically linked, the system need only use a single sensor 41 that is configured to determine when the mechanism is deployed. In use, the sensor 41 may communicate with a drive control system to limit drive functions or the like when the platform is raised.

The pothole protection mechanism 12 may also include a deploy spring 42 that is cooperable with the plunger bar 18 and is configured to bias the plunger bar 18 toward displacing the arm assemblies 20 to the deployed position (FIG. 3). The deploy spring 42 helps the system deploy so that it does not rely entirely on component weight to deploy the pothole protection bars 30. This allows for weight and cost optimization of the components and will aid in deployment as corrosion and debris contamination build up during use.

The pothole protection mechanism 12 may also include an actuator spring 44 that is cooperable with the plunger bar 18. The actuator spring 44 is configured to permit lift down of the lifting section 16 when the arm assemblies 20 are stuck in the deployed position. With reference to FIGS. 2 and 3, in an exemplary construction, the plunger bar 18 includes a connecting collar secured on a shaft. The connecting collar is attached directly to the lifting section 16 of the lift vehicle. The actuator spring 44 is positioned over the shaft between the connecting collar and a shoulder. In normal operation, the plunger bar 18 is displaced downward as the platform is lowered, which serves to raise the pothole protection bars 30 to the retracted configuration. If the pothole protection bars 30 are stuck, however, the platform can still be lowered as the connecting collar will compress the actuator spring 44 between the collar and the shoulder.

In some embodiments, the arm assemblies 20 are configured such that the bar arms 26 are pivoted "over center" on the second pivot pin 28 when the arm assemblies 20 are displaced from the retracted position to the deployed position. The over-center position when deployed keeps the system rigid in case of pothole impact.

Figure 5:
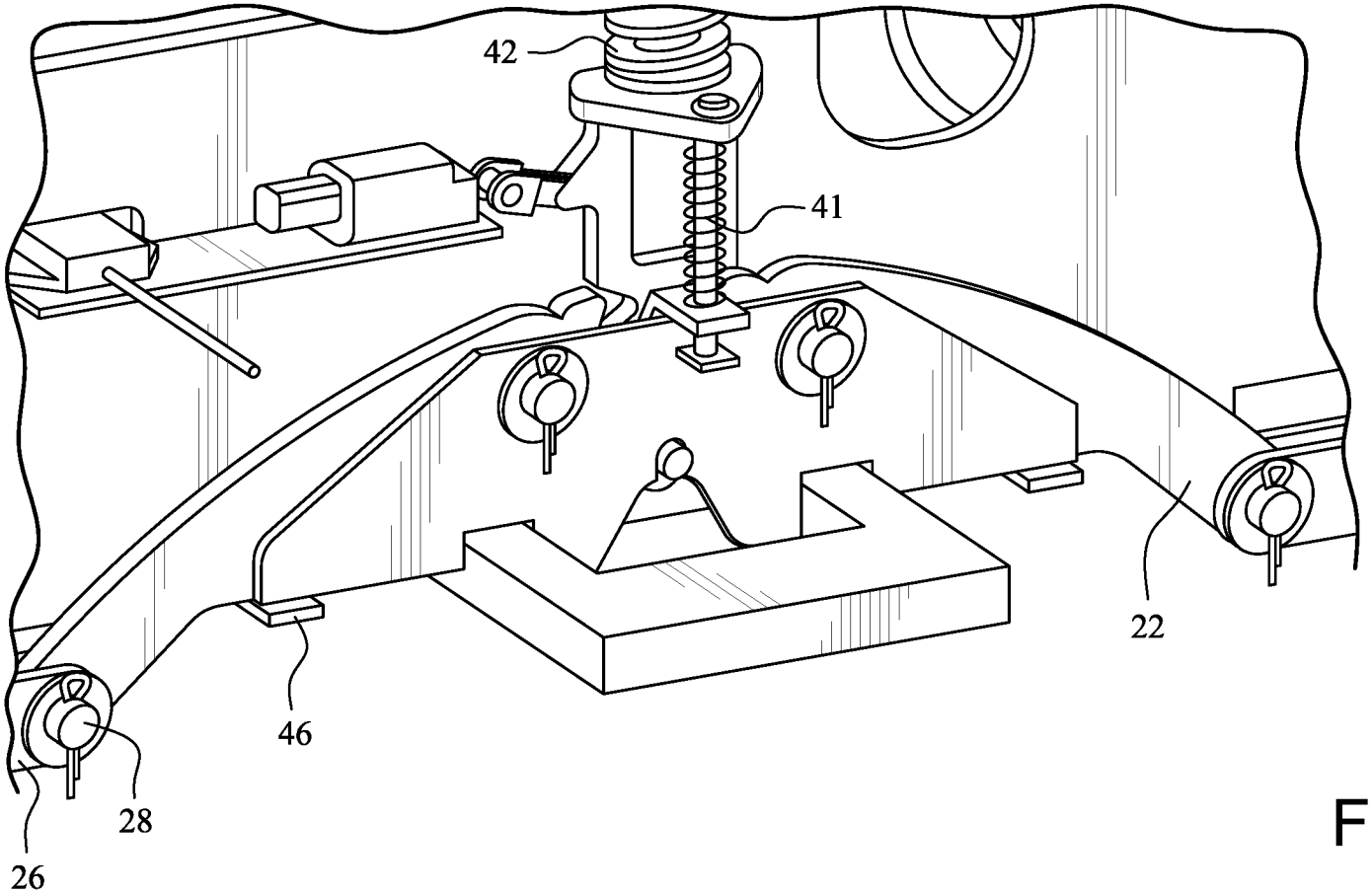
FIG. 5 shows a stop member of the vehicle frame with which the pothole protection mechanism is engaged in the deployed configuration.

With reference to FIG. 5, the frame 14 may include stop members 46 with which the extension arms 22 or the bar arms 26 are engageable in the deployed position. As shown the stop members 46 are disposed in a deploy path of the arm assemblies. The stop members 46 and the slots in the bar mounting tabs 34 allow the pothole protection bars 30 and the frame 14 to take impact loading, thereby allowing the rest of the components to be optimized. That is, since any impact can be borne by the vehicle frame 14, smaller, lighter weight and less expensive components can be used for the pothole protection mechanism 12.

In use, as the lift machine platform is raised, the plunger bar 18 is similarly driven upward. The deploy spring 42 provides assistance in displacing the pothole protection mechanism 12 from the retracted configuration to the deployed configuration. Displacement of the arm assembly allows the pothole protection bars 30 to drop down, thereby limiting the amount of clearance the lift machine has to the ground. In the deployed position, the arm assemblies 20 are pivoted into the over-center position and are abutted against the stop members 46.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A lift vehicle comprising:

a vehicle frame;

a lifting section supported on the vehicle frame; and a pothole protection mechanism, the pothole protection mechanism comprising:

a plunger bar displaceable with the lifting section, a pair of arm assemblies displaceable by the plunger bar between a retracted position and a deployed position, each of the arm assemblies including an extension arm engaged with the plunger bar and pivotable on a first pivot pin and a bar arm pivotably coupled at a proximal end to the extension arm on a second pivot pin, and a pair of pothole protection bars, one each pivotably coupled on a third pivot pin to respective distal ends of the bar arms via respective bar mounting tabs, each of the bar mounting tabs being pivotably connected to the vehicle frame, wherein the arm assemblies are configured such that the bar arms are pivoted over center on the second pivot pin when the arm assemblies are displaced from the retracted position to the deployed position, and wherein the pothole protection bars rest against the vehicle frame in the deployed position.

2. A lift vehicle according to claim 1, wherein the vehicle frame includes stop members disposed in a deploy path of the arm assemblies, and wherein in the deployed position, either the bar arms or the extension arms are engaged with the stop members.

3. A lift vehicle according to claim 2, wherein each of the bar mounting tabs comprises a slot in which the pothole protection bar is positioned.

4. A lift vehicle according to claim 1, wherein each of the bar mounting tabs comprises a slot in which the pothole protection bar is positioned, the slot being sized and oriented such that the pothole protection bars are displaceable relative to the bar mounting tabs into engagement with the vehicle frame during a pothole impact.

5. A lift vehicle according to claim 1, wherein the pothole protection mechanism further comprises a deploy spring cooperable with the plunger bar, the deploy spring being configured to bias the plunger bar toward displacing the arm assemblies to the deployed position.

6. A lift vehicle according to claim 1, wherein the plunger bar is linked to the pair of arm assemblies.

7. A lift vehicle according to claim 6, wherein the plunger bar comprises a two-sided rack, and wherein each of the extension arms comprises a pinion at proximal ends thereof engaging respective sides of the two-sided rack.

8. A lift vehicle according to claim 7, wherein the pothole protection mechanism further comprises an actuator spring cooperable with the plunger bar, the actuator spring being configured to permit lift down of the lifting section when the arm assemblies are stuck in the deployed position.

9. A lift vehicle according to claim 7, further comprising a single sensor configured to determine when the mechanism is deployed.

10. A lift vehicle according to claim 1, wherein the pothole protection mechanism further comprises an actuator spring cooperable with the plunger bar, the actuator spring being configured to permit lift down of the lifting section when the arm assemblies are stuck in the deployed position.

* * * * *